US011035646B2

(12) United States Patent
Teetzel et al.

(10) Patent No.: US 11,035,646 B2
(45) Date of Patent: Jun. 15, 2021

(54) GRENADE LAUNCHER WITH MODULAR INTERFACE

(71) Applicant: Wilcox Industries Corp., Newington, NH (US)

(72) Inventors: James W. Teetzel, Portsmouth, NH (US); Gary M. Lemire, Lee, NH (US); John P. Bousquet, Rochester, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 16/725,257

(22) Filed: Dec. 23, 2019

(65) Prior Publication Data

US 2020/0284549 A1 Sep. 10, 2020

Related U.S. Application Data

(60) Provisional application No. 62/783,738, filed on Dec. 21, 2018.

(51) Int. Cl.
*F41C 27/06* (2006.01)
*F41A 19/10* (2006.01)
(Continued)

(52) U.S. Cl.
CPC ..... *F41C 27/06* (2013.01); *F41A 11/02* (2013.01); *F41A 19/10* (2013.01); *F41C 23/10* (2013.01); *F41C 23/16* (2013.01)

(58) Field of Classification Search
CPC ..... F41C 27/06; F41C 23/10; F41C 23/16; F41A 11/02; F41A 19/10
(Continued)

(56) References Cited

U.S. PATENT DOCUMENTS 3,279,114 A 10/1966 Lewis et al.
3,332,162 A 7/1967 Martwick et al.
(Continued)

FOREIGN PATENT DOCUMENTS

WO 2016089863 A2 6/2016

OTHER PUBLICATIONS

"Glock Super Tactical Body Dropper" (Handgun Holsters and Guns) (online) (retrieved from the Internet an 39.03.2016) <URL https://brakenlizard.wardpress.com/2010/10/15/glock-super-tactical-body-dropper/> Oct. 15, 2010.
(Continued)

*Primary Examiner* — Bret Hayes
(74) *Attorney, Agent, or Firm* — McLane Middleton, Professional Association

(57) ABSTRACT

A grenade launcher system comprises a grenade launcher receiver and a grenade launcher barrel attached to the grenade launcher receiver. A trigger assembly is attached to the grenade launcher receiver at a position adjacent the grenade launcher barrel. The grenade launcher receiver has an elongate channel disposed on an upper surface of the grenade launcher receiver, the elongate channel extending parallel to the grenade launcher barrel and configured to slidably and removably receive a mounting rail. In certain embodiments, the grenade launcher system is configured to operate in an underslung configuration relative to a firearm. In certain embodiments, the grenade launcher system is configured to operate in a standalone configuration without a firearm.

18 Claims, 5 Drawing Sheets

(51) Int. Cl.
*F41C 23/16* (2006.01)
*F41C 23/10* (2006.01)
*F41A 11/02* (2006.01)

(58) Field of Classification Search
USPC ..... 42/105
See application file for complete search history.

(56) References Cited

U.S. PATENT DOCUMENTS 3,365,828 A 1/1968 Badali et al.
3,442,173 A 5/1969 Muller
3,507,067 A 4/1970 Into
3,557,482 A 1/1971 Hoover
3,641,691 A 2/1972 Ellis et al.
3,967,402 A 7/1976 Cooksey
3,967,403 A 7/1976 Reynolds
4,019,424 A 4/1977 Reynolds
4,603,498 A 8/1986 Johnson
4,689,911 A 9/1987 White
4,733,489 A * 3/1988 Kurak ..... F41C 27/06 42/105
5,052,144 A 10/1991 Ostor
5,146,705 A 9/1992 Martin
5,198,600 A * 3/1993 E'Nama ..... F41C 27/00 42/105
5,235,771 A 8/1993 Sokol et al.
5,591,932 A 1/1997 Staiert et al.
5,669,174 A 9/1997 Teetzel
5,689,908 A 11/1997 Brandl
5,930,935 A * 8/1999 Griffin ..... F41C 27/06 42/105
6,142,058 A 11/2000 Mayville et al.
6,250,194 B1 6/2001 Brandl et al.
6,453,594 B1 9/2002 Griffin
6,481,145 B2 11/2002 Weichert et al.
6,752,137 B2 6/2004 Brunette et al.
6,829,858 B2 * 12/2004 Gablowski ..... F41C 27/06 42/105
D517,637 S 3/2006 Murello et al.
7,010,879 B2 3/2006 Olsen
7,021,187 B1 4/2006 Grassi
7,143,539 B2 12/2006 Cerovic et al.
7,269,920 B2 9/2007 Staley, III
7,328,530 B2 2/2008 Griffin
7,360,478 B2 4/2008 Compton et al.
7,409,912 B2 8/2008 Cerovic et al.
7,458,179 B2 12/2008 Swan
7,487,612 B2 2/2009 Macaluso
7,661,348 B2 2/2010 Murello
7,891,130 B2 2/2011 Griffin
7,966,763 B1 6/2011 Schneider et al.
8,020,334 B2 9/2011 Delmonico
8,141,289 B2 3/2012 Gomez et al.
8,191,300 B2 6/2012 Daniel
8,209,897 B2 7/2012 Schneider et al.
8,296,985 B2 10/2012 Krutil et al.
8,393,107 B2 3/2013 Brown
8,459,996 B2 6/2013 Sullivan
8,549,783 B2 10/2013 Marquez
8,991,091 B2 3/2015 Griffin
9,021,733 B1 5/2015 DiChario
9,228,801 B2 1/2016 Hosz
9,618,299 B1 4/2017 Gingrich
10,119,781 B1 11/2018 Teetzel et al.
10,578,396 B2 3/2020 Teetzel et al.
2001/0042334 A1 11/2001 Weichert et al.
2002/0092224 A1 * 7/2002 Weichert ..... F41G 1/48 42/105
2004/0025395 A1 2/2004 Gablowski
2005/0132628 A1 6/2005 Olson
2005/0188593 A1 9/2005 Cerovic et al.
2006/0026884 A1 * 2/2006 Cerovic ..... F41H 13/0012 42/84
2006/0026885 A1 2/2006 Tony
2006/0201044 A1 9/2006 Griffin
2006/0272193 A1 * 12/2006 Zedrosser ..... F41C 27/06 42/105
2007/0068057 A1 3/2007 Macaluso
2007/0074437 A1 4/2007 Compton et al.
2008/0216378 A1 9/2008 Murello
2009/0178325 A1 7/2009 Veilleux
2009/0277069 A1 11/2009 Delmonico
2010/0192439 A1 8/2010 Murello
2011/0010981 A1 1/2011 Wieland
2011/0016765 A1 1/2011 Griffin
2011/0131857 A1 6/2011 Kuczynko et al.
2012/0144712 A1 6/2012 Rostocil
2012/0151813 A1 * 6/2012 Brown ..... F41C 7/00 42/73
2012/0297970 A1 11/2012 Langevin et al.
2014/0190061 A1 7/2014 Griffin
2014/0237883 A1 * 8/2014 Hosz ..... F41C 27/00 42/105
2015/0000173 A1 * 1/2015 Griffin ..... F41C 27/06 42/105
2015/0007477 A1 1/2015 Langevin et al.
2015/0107143 A1 4/2015 Coetzee et al.
2015/0135576 A1 5/2015 Wells et al.
2016/0153744 A1 * 6/2016 Teetzel ..... F41C 23/04 42/105
2018/0321013 A1 11/2018 Teetzel et al.
2019/0011219 A1 * 1/2019 Mezynski ..... F41C 27/06
2019/0162505 A1 * 5/2019 Mezynski ..... F41C 27/00
2020/0284549 A1 9/2020 Teetzel et al.

OTHER PUBLICATIONS

Search Report dated Mar. 25, 2016 received in PCT/US2015/063175.

* cited by examiner

GRENADE LAUNCHER WITH MODULAR INTERFACE

CROSS REFERENCE TO RELATED APPLICATIONS

This application claims the priority benefit of U.S. Provisional Application No. 62/783,738 filed Dec. 21, 2018. The aforementioned application is incorporated herein by reference in its entirety.

INCORPORATION BY REFERENCE

This application is related to U.S. Provisional Application No. 62/085,967, filed Dec. 1, 2014, and U.S. Non-Provisional application Ser. No. 14/955,363, filed Dec. 1, 2015. Each of the aforementioned applications is incorporated herein by reference in its entirety.

BACKGROUND

The present invention relates generally to a modular grenade launcher system which provides quick attachment and removal from a firearm and/or firearm accessory rail sections. In certain embodiments, the modular grenade launcher system herein may be used in configuration with a firearm, e.g., in an underslung configuration, or, in other embodiments, as a standalone weapon.

SUMMARY

In one aspect, a grenade launcher system comprises a grenade launcher receiver and a grenade launcher barrel attached to the grenade launcher receiver. A trigger assembly is attached to the grenade launcher receiver at a position adjacent the grenade launcher barrel. The grenade launcher receiver has an elongate channel disposed on an upper surface of the grenade launcher receiver, the elongate channel extending parallel to the grenade launcher barrel and configured to slidably and removably receive a mounting rail.

In a more limited aspect, the mounting rail is selected from the group consisting of an accessory rail of a firearm and a stock rail of grenade launcher stock.

In another more limited aspect, the mounting rail is an accessory rail disposed on a lower hand guard portion of an assault rifle.

In yet another more limited aspect, the accessory rail is a Picatinny rail interface.

In another more limited aspect, the grenade launcher system further comprises one or more locking fasteners on the receiver for securing the mounting rail in a fixed position within the elongate channel.

In another more limited aspect, the grenade launcher system further comprises a ladder sight assembly and one or more tapped openings disposed on the receiver, the one or more tapped openings having internal threads receiving threaded fasteners for removably attaching the ladder sight assembly to the grenade launcher receiver.

In yet another more limited aspect, the ladder sight assembly includes a base portion with a front sight and a rear ladder sight axially spaced apart from the front sight.

In still another more limited aspect, one or both of the front sight and the rear ladder sight is pivotally attached to the base portion to permit one or both of the front sight and the rear ladder sight to be folded down when not in use.

In another more limited aspect, the grenade launcher system of claim 1, further comprises a ladder sight assembly, one or more tapped openings disposed on a first transverse side of the receiver, the one or more tapped openings having internal threads receiving threaded fasteners for removably attaching the ladder sight assembly to the first transverse side of the receiver, and one or more tapped openings disposed on a second transverse side of the receiver, the one or more tapped openings having internal threads receiving threaded fasteners for removably attaching the ladder sight assembly to the second transverse side of the receiver.

In another more limited aspect, the grenade launcher system further comprises a ladder sight assembly configured to be removably attached to the firearm.

In another more limited aspect, the grenade launcher system further comprises a pistol grip attached to the grenade launcher receiver adjacent the trigger assembly.

In yet another more limited aspect, the pistol grip includes a main grip portion and a removable grip portion, wherein the removable grip portion is removably attached to the main grip portion.

In still another more limited aspect, the grenade launcher system is configured for removable attachment to a firearm having a magazine well, and the main grip portion has a size and shape to provide clearance beneath the magazine well to permit insertion and removal of a magazine in the magazine well without interference by the pistol grip when the grenade launcher system is attached to the firearm.

In yet another more limited aspect, the pistol grip portion is removably attached to the grenade launcher receiver.

In another more limited aspect, the barrel is pivotally attached to the grenade launcher receiver at or near a muzzle end of the barrel to allow a breech end of the barrel to pivot away from the receiver.

In yet another more limited aspect, the grenade launcher system further comprises a latch mechanism on the grenade launcher receiver for selectively locking the grenade launcher barrel with respect to the grenade launcher receiver to prevent pivoting movement of the grenade launcher barrel and unlocking the grenade launcher barrel with respect to the grenade launcher receiver to allow pivoting movement of the grenade launcher barrel.

In another more limited aspect, the grenade launcher system further comprises a grenade launcher stock assembly, the grenade launcher stock assembly including a stock rail and a shoulder support. The stock rail has a first end and a second end opposite the first end. The first end is configured to be slidably received within the elongate channel, wherein the shoulder support is attached to the second end.

In yet another more limited aspect, the grenade launcher system, further comprises at least one toggle clamp for selectively locking and unlocking the stock rail, wherein a position of the stock rail within the elongate channel is slidably adjustable when the at least one toggle clamp is unlocked and wherein the position of the stock rail is fixed when the at least one toggle clamp is locked.

In another more limited aspect, the grenade launcher system further comprises a firing mechanism operably coupled to the trigger assembly.

In yet another more limited aspect, the firing mechanism is integral with one of the receiver and a pistol grip attached to the grenade launcher receiver.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
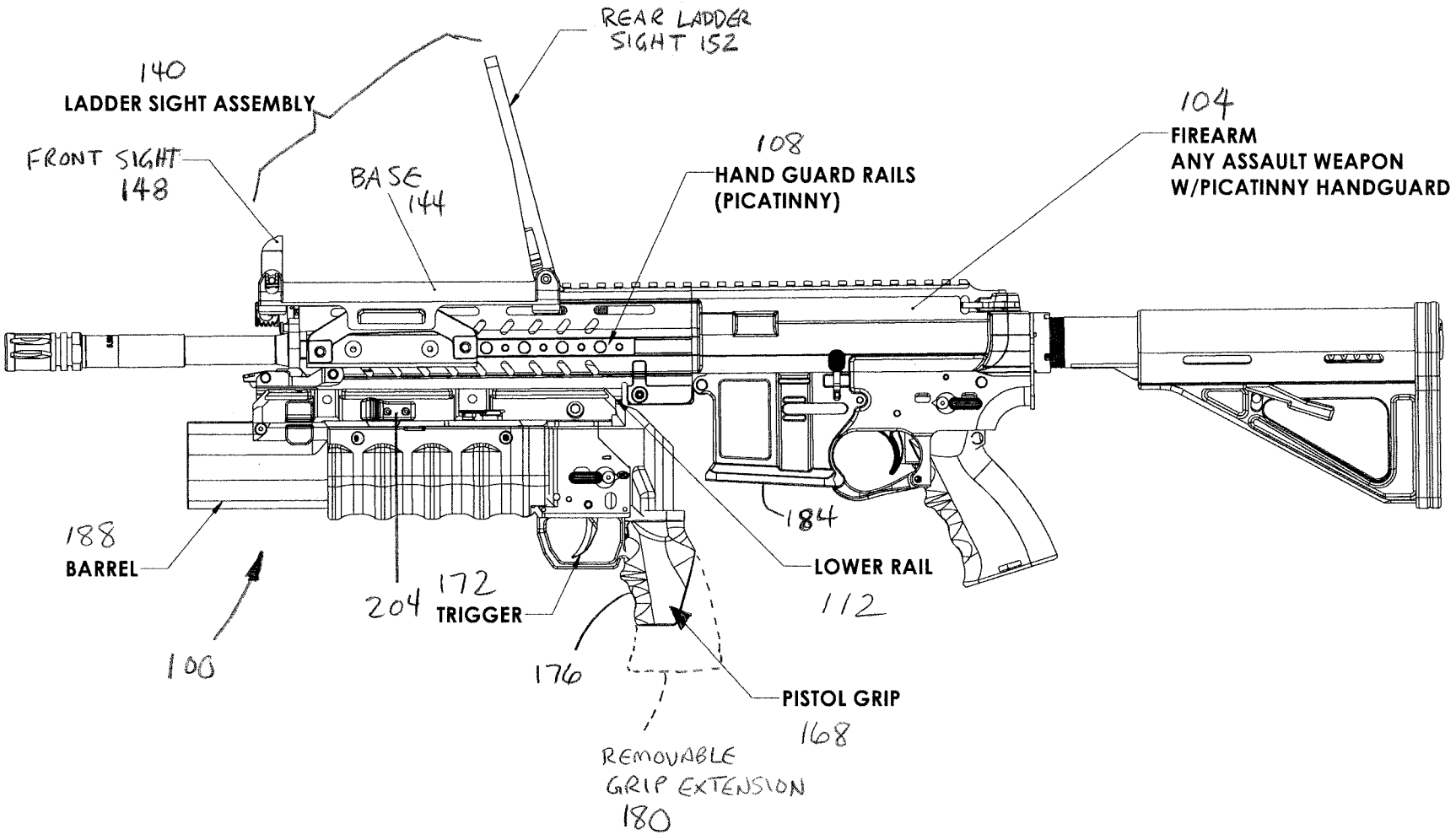
FIG. 1 is a side view of an exemplary embodiment grenade launcher system herein attached to an assault rifle.
Figure 2:
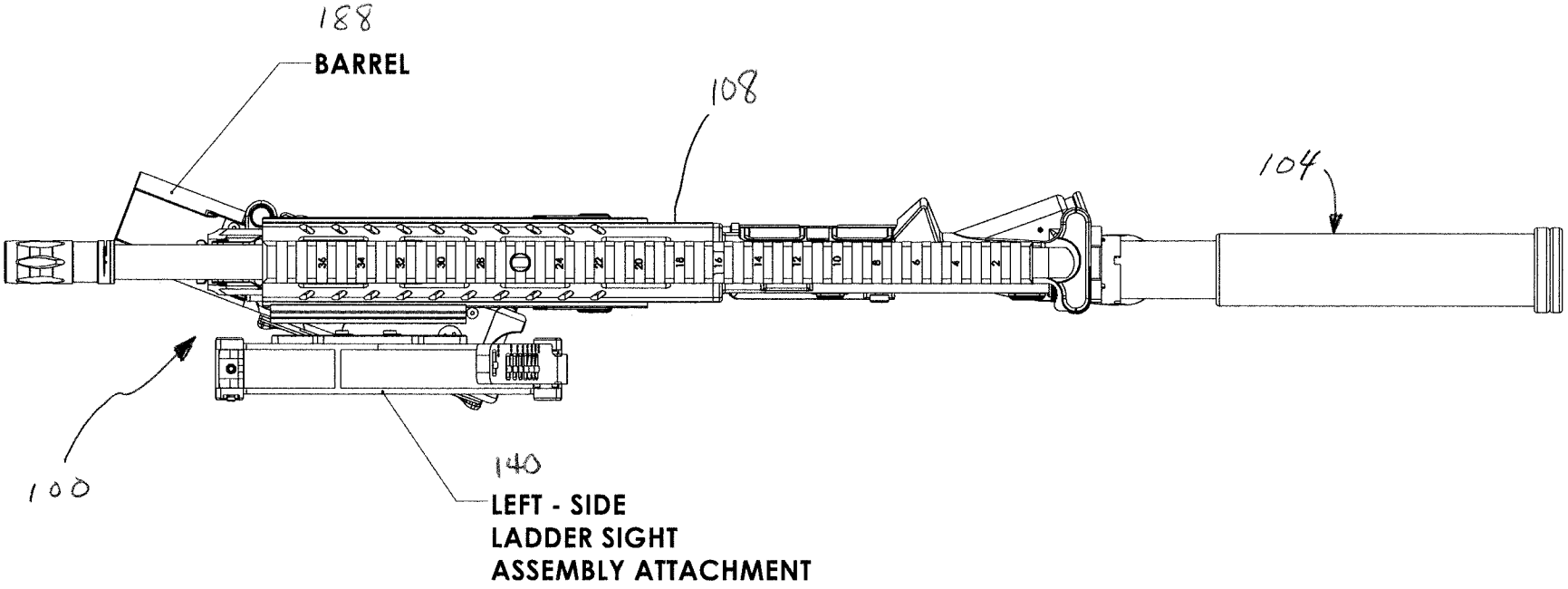
FIG. 2 is a top view of the grenade launcher system appearing in FIG. 1.
Figure 3:
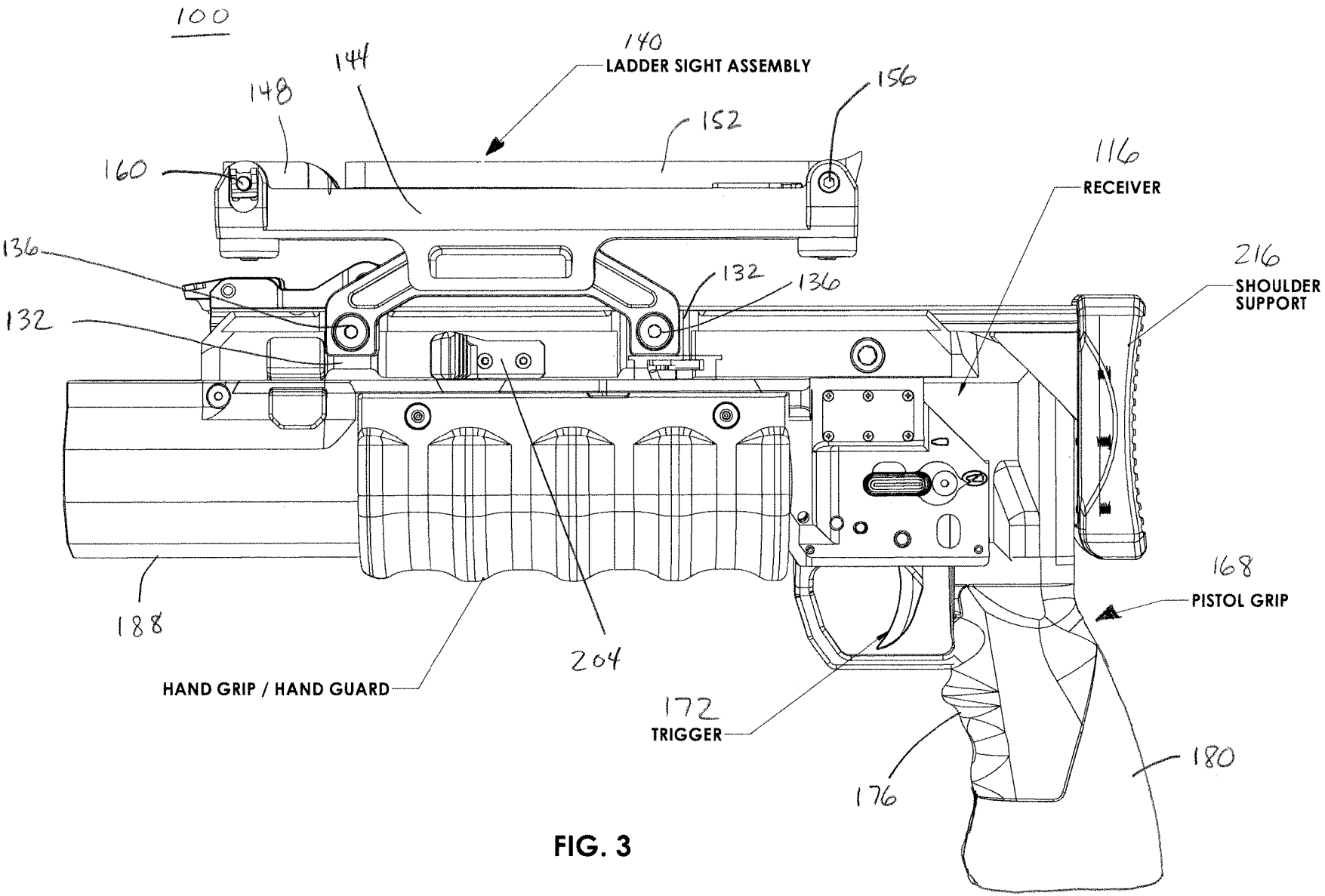
FIG. 3 is a side view of a modular grenade launcher embodiment configured for a standalone operation.
Figure 4:
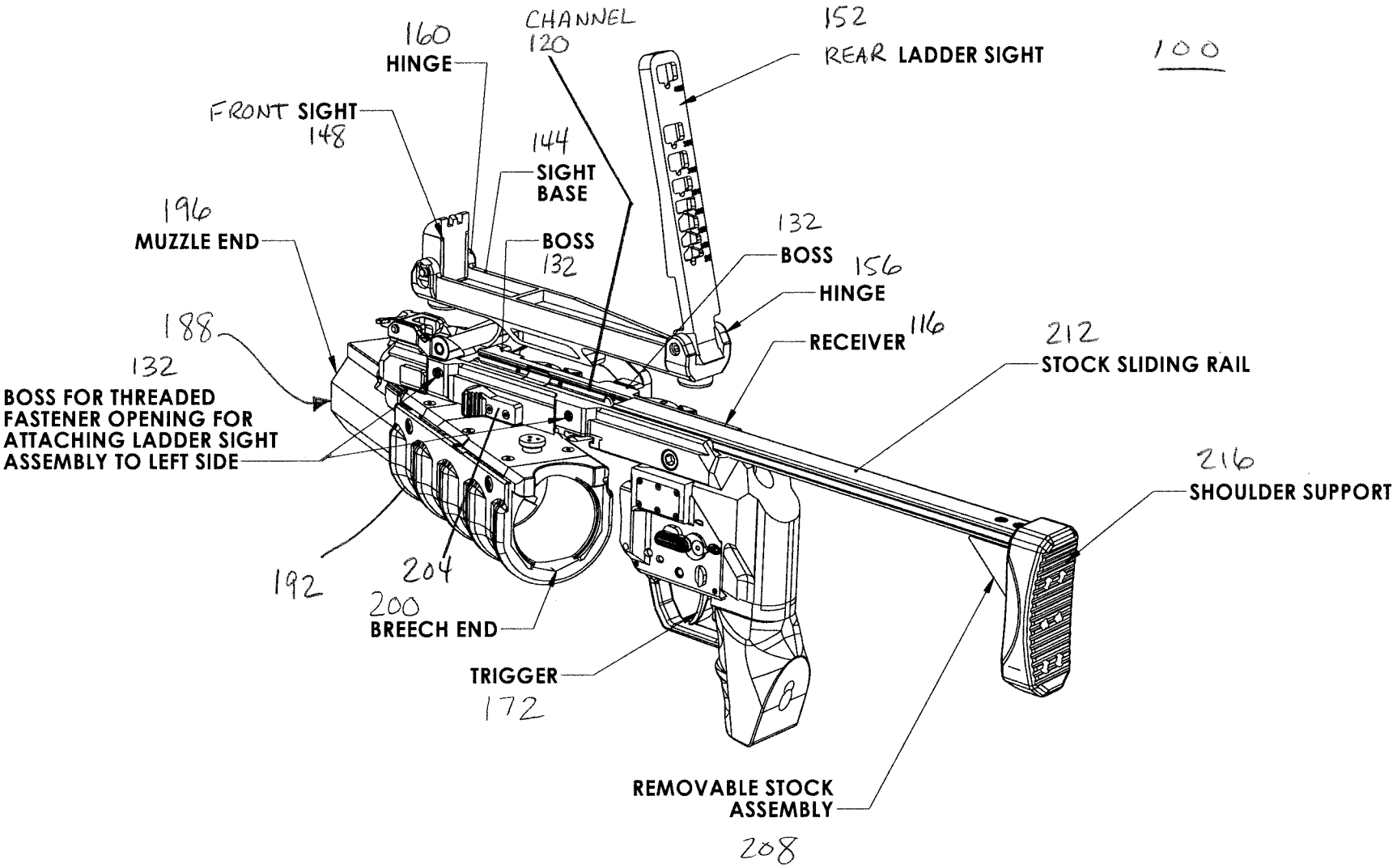
FIG. 4 is an isometric view of the modular grenade launcher embodiment appearing in FIG. 3, where the ladder sight assembly is positioned on the right side of the receiver, the breech end of the barrel is pivoted to the left of the trigger assembly, and the shoulder support is in an extended position.
Figure 5:
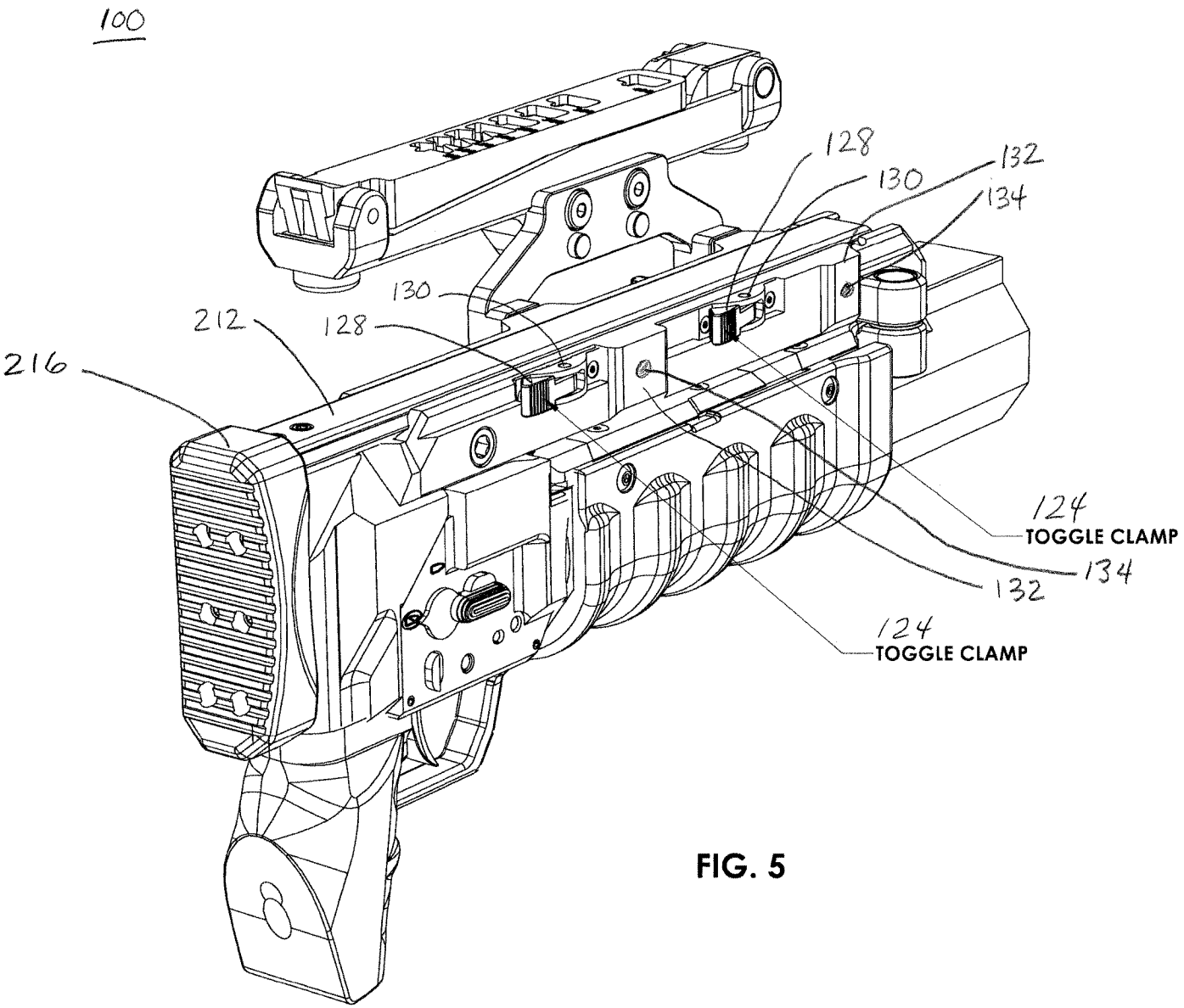
FIG. 5 is an isometric view of the grenade launcher embodiment appearing in FIG. 3, where the ladder sight assembly is configured on the left side of the receiver and the shoulder support is in a retracted position.

Referring now to the drawings, an exemplary modular grenade launcher system 100 attached to a firearm 104 appears in FIGS. 1 and 2, i.e., in an under-barrel configuration. FIGS. 3-5 illustrate a standalone grenade launcher configuration. The firearm to which the modular grenade launcher is to be attached may be any military or tactical assault weapon having a tactical accessory rail/hand guard 108, including for example, M4, AR15, or M16 assault weapons. Exemplary firearm accessory rails include Picatinny (e.g., MIL-STD-1913, STANAG-2324) rails and the like. In certain embodiments, when the grenade launcher system is attached to a firearm, the grenade launcher system 100 is secured to a lower rail portion 112 of the hand guard 108 for such firearm.

Turning now to FIG. 3, the grenade launcher system 100 includes a receiver 116 configured for attachment to the lower rail 112. The receiver 116 comprises a groove 120 extending along its upper surface complementary with, and configured to slidably receive, the lower rail 112. One or more fasteners 124 are provided on the receiver 116 to secure the rail 112 within the channel 120 (see FIG. 5). In certain embodiments, the one or more locking fasteners 124 are one or more toggle clamps comprising a pivoting lever 128, e.g., with an eccentric or off-center pivot axis 130 to define a cam surface, which can be pivoted between a locked and unlocked position to selectively secure and release the receiver 116 with respect to the lower rail 108.

In certain embodiments, the receiver 116 includes one or more mounting bosses 132 having threaded openings 134 which receive corresponding threaded fasteners 136 for attaching a ladder sight assembly 140. The ladder sight assembly 140 includes a base portion 144 with a front sight 148 and a rear ladder sight 152. In certain embodiments, the rear ladder sight 152 is pivotally attached to the rearward end of the base portion 144 via a rear hinge or hinge pin 156 to permit the rear ladder sight 152 to be folded down when not in use. In certain embodiments, the front sight 148 is pivotally attached to the forward end of the base 144 via a front hinge 160 to permit the front sight 148 to be folded down when not in use. It will be recognized, however, that one or both of the front sight 148 and rear ladder sight 152 may be fixed or nonfolding. The base portion 144 of the ladder sight assembly is secured to the receiver via the threaded fasteners 136 engaging the threaded bosses 132. In certain embodiments, threaded bosses 132 are provided on both the left side and right side of the receiver 116 to permit the ladder sight assembly 140 to be removably and selectively attached to either the left or right side of the receiver 116 in accordance with the preference of the grenadier.

In certain embodiments, when the modular grenade launcher system 100 is mounted to the firearm 104, for example, in an underslung configuration as shown in FIGS. 1 and 2, the ladder sight assembly 140 may be configured to removably attach to a rail portion of the handguard 108. The ladder sight assembly may be attached to the tactical rail assembly, e.g., by means of a rail clamp adapter having threaded bosses or other mechanical fasteners.

In certain embodiments, the receiver 116 houses a firing mechanism (not shown), e.g., for actuating a firing pin which strikes the primer of a cartridge responsive to a trigger pull, is housed within the receiver 116 and is operatively coupled to a trigger 172. In certain embodiments, the trigger 172 is coupled to the firing mechanism via a mechanical linkage. In certain alternative embodiments, the trigger 172 is operably connected to the firing mechanism via an electrical or electromechanical linkage.

Commonly, under-barrel grenade launchers lack a pistol grip, wherein a magazine (not shown) inserted into the magazine well 184 of the firearm 104 serves as a handgrip when operating the grenade launcher. In certain embodiments, the receiver 116 also includes a handgrip, such as a pistol grip, 168 attached thereto. In certain embodiments, the pistol grip 168 is removably attached to the receiver 116.

In certain further embodiments, the pistol grip 168 includes a main grip portion 176 and a removable grip portion 180, wherein the removable grip portion 180 is removably attached to the main grip portion 176 for adapting the grenade launcher system 100 for use as a standalone weapon and removed from the main grip portion 176 when used as an under-barrel system mounted to a firearm. When the grenade launcher system 100 is being used in the firearm-mounted configuration, the removable grip portion 180 may be removed, as illustrated in FIGS. 1 and 2. In this manner, clearance beneath the magazine well 184 of the firearm 104 is provided to permit insertion of a magazine into the magazine well without interference by the pistol grip when used in the under barrel configuration while providing a larger or more ergonomic pistol grip configuration when used in the standalone configuration.

In certain embodiments, the entire pistol grip portion 168, including both the main grip portion 176 and the removable grip portion 180 is configured to be removed from the modular grenade launcher 100 when used in the underslung configuration and attached when the grenade launcher system 100 is being used in a standalone configuration.

The grenade launcher system 100 further includes a barrel 188, which is pivotally attached to the receiver 116. In certain further embodiments, the barrel 188 includes a hand guard portion 192. In certain embodiments, the barrel 188 is configured to selectively pivot at or near the muzzle end 196 to allow the rear or breech end 200 of the barrel 188 to pivot relative to the receiver 116 for removing a spent cartridge casing of a fired round and to load another cartridge round for firing. In certain embodiments, pivoting movement of the barrel 188 is actuated by manually sliding a latch release mechanism 204. In certain embodiments, the barrel pivot mechanism may be as described in commonly owned U.S. application Ser. No. 14/955,363 to allow the rearward end of the barrel assembly to selectively pivot away from the firing mechanism to either the left or the right, as desired by the user, e.g., based on the handedness of the operator, for the purpose of chambering another round. In other embodiments, the breech end of the barrel is configured to pivot away from the firing mechanism in a single mechanism only, e.g., to the left side as in the embodiment illustrated in FIGS. 2 and 4.

With reference now to FIGS. 3, 4, and 5, the modular grenade launcher system 100 herein appears in a configuration for use as a standalone weapon, i.e., without an associated firearm. The standalone configuration includes a removable stock assembly 208 comprising a stock sliding rail 212 and shoulder support 216. The sliding stock rail 212 is slidably received within the channel 120. When the toggle clamps 128 are in the unlocked position, the sliding rail 212 can be slid to the forward most position as shown in FIG. 5 secured by locking the toggle clamps 128, e.g., for storage and transport. During operation, the toggle clamps 128 are moved to the unlocked position and the sliding rail 212 is slid a desired distance rearward to move the shoulder support 216 to a desired position in accordance with the user's size and preference. The sliding rail 212 is then secured at the desired position by moving the toggle clamps 128 to the locked position.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims and equivalents thereof.

What is claimed is:

1. A grenade launcher system, comprising:

a grenade launcher receiver;

a grenade launcher barrel attached to the grenade launcher receiver; and a trigger assembly attached to the grenade launcher receiver at a position adjacent the grenade launcher barrel;

the grenade launcher receiver having an elongate channel disposed on an upper surface of the grenade launcher receiver, the elongate channel extending parallel to the grenade launcher barrel and configured to slidably and removably receive a mounting rail;

a grenade launcher stock assembly, the grenade launcher stock assembly including a stock rail and a shoulder support;

the stock rail having a first end and a second end opposite the first end, the first end configured to be slidably received within the elongate channel, wherein the shoulder support is attached to the second end;

at least one toggle clamp for selectively locking and unlocking the stock rail, wherein a position of the stock rail within the elongate channel is slidably adjustable when the at least one toggle clamp is unlocked and wherein the position of the stock rail is fixed when the at least one toggle clamp is locked.

2. The grenade launcher system of claim 1, wherein the mounting rail is selected from the group consisting of an accessory rail of a firearm and a stock rail of grenade launcher stock.

3. The grenade launcher system of claim 1, wherein the mounting rail is an accessory rail disposed on a lower hand guard portion of an assault rifle.

4. The grenade launcher system of claim 1, wherein the mounting rail is a Picatinny rail interface.

5. The grenade launcher system of claim 1, further comprising one or more locking fasteners on the receiver for securing the mounting rail in a fixed position within the elongate channel.

6. The grenade launcher system of claim 1, further comprising:

a ladder sight assembly; and one or more tapped openings disposed on the receiver, the one or more tapped openings having internal threads receiving threaded fasteners for removably attaching the ladder sight assembly to the grenade launcher receiver.

7. The grenade launcher system of claim 6, wherein the ladder sight assembly includes a base portion with a front sight and a rear ladder sight axially spaced apart from the front sight.

8. The grenade launcher system of claim 7, wherein one or both of the front sight and the rear ladder sight is pivotally attached to the base portion to permit one or both of the front sight and the rear ladder sight to be folded down when not in use.

9. The grenade launcher system of claim 1, further comprising:

a ladder sight assembly;

one or more tapped openings disposed on a first transverse side of the receiver, the one or more tapped openings having internal threads receiving threaded fasteners for removably attaching the ladder sight assembly to the first transverse side of the receiver; and one or more tapped openings disposed on a second transverse side of the receiver, the one or more tapped openings having internal threads receiving threaded fasteners for removably attaching the ladder sight assembly to the second transverse side of the receiver.

10. The grenade launcher system of claim 1, further comprising a ladder sight assembly configured to be removably attached to the firearm.

11. The grenade launcher system of claim 1, further comprising a pistol grip attached to the grenade launcher receiver adjacent the trigger assembly.

12. The grenade launcher system of claim 11, wherein the pistol grip includes a main grip portion and a removable grip portion, wherein the removable grip portion is removably attached to the main grip portion.

13. The grenade launcher system of claim 12, wherein the grenade launcher system is configured for removable attachment to a firearm having a magazine well, and further wherein the main grip portion has a size and shape to provide clearance beneath the magazine well to permit insertion and removal of a magazine in the magazine well without interference by the pistol grip when the grenade launcher system is attached to the firearm.

14. The grenade launcher system of claim 11, wherein the pistol grip is removably attached to the grenade launcher receiver.

15. The grenade launcher system of claim 1, wherein the barrel is pivotally attached to the grenade launcher receiver at or near a muzzle end of the barrel to allow a breech end of the barrel to pivot away from the receiver.

16. The grenade launcher system of claim 15, further comprising a latch mechanism on the grenade launcher receiver for selectively locking the grenade launcher barrel with respect to the grenade launcher receiver to prevent pivoting movement of the grenade launcher barrel and unlocking the grenade launcher barrel with respect to the grenade launcher receiver to allow pivoting movement of the grenade launcher barrel.

17. The grenade launcher system of claim 1, further comprising a firing mechanism operably coupled to the trigger assembly.

18. The grenade launcher system of claim 17, wherein the firing mechanism is integral with one of the receiver and a pistol grip attached to the grenade launcher receiver.

* * * * *